US005379015A

United States Patent [19]

Lehmeier et al.

[11] Patent Number: 5,379,015

[45] Date of Patent: Jan. 3, 1995

[54] LATCHING BLOCK FOR ELECTROMAGNETIC SWITCHING DEVICES

[75] Inventors: Johann Lehmeier, Lauterhofen; Erwin Flierl, Rieden; Gerhard Schroether, Amberg, all of Germany

[73] Assignee: Siemens Aktiengesellschaft, Munich, Germany

[21] Appl. No.: 92,293

[22] Filed: Jul. 15, 1993

[30] Foreign Application Priority Data

Jul. 16, 1992 [DE] Germany ..... 9209555[U]

[51] Int. Cl.[6] ..... H01H 3/00

[52] U.S. Cl. ..... 335/185; 335/132; 335/202; 335/167

[58] Field of Search ..... 335/132, 167–172, 335/138–140, 185–190, 191, 202

[56] References Cited

U.S. PATENT DOCUMENTS 3,763,713 10/1973 Ford et al. ..... 335/228
4,225,838 9/1980 Le Roue ..... 335/274
4,307,361 12/1981 Grunert et al. ..... 335/132
4,956,624 9/1990 Streich et al. .

FOREIGN PATENT DOCUMENTS 2625292 12/1977 Germany .

*Primary Examiner*—Lincoln Donovan
*Attorney, Agent, or Firm*—Kenyon & Kenyon

[57] ABSTRACT

A latching block to be coupled to an electromagnetic switching device, which holds the switching device in the working position by locking the mechanism of the switching device which carries out the switching action. The latching block has a housing, a rack which can be coupled to the mechanism which carries out the switching action with a positive lock, and a lever which acts on a ratchet wheel. The engagement of the lever and the ratchet wheel can be released for unlocking.

16 Claims, 2 Drawing Sheets

LATCHING BLOCK FOR ELECTROMAGNETIC SWITCHING DEVICES

BACKGROUND OF THE INVENTION

The present invention relates to a latching block which is connected to an electromagnetic switching device, and more particularly to a latching block which holds the switch in a closed position by locking in place that mechanism of the switching device which carries out the switching action.

A latching block for an electromagnetic switching device is described in German Patent No. DE-PS 26 25 292. In the configuration disclosed in that document, the locking mechanism has a toggle joint. The toggle joint locks that mechanism that reverses the switching action in the extended position, past the center point. The toggle joint is positioned past the center point by spring stress. Removal of the lock is carried out by an electromagnetically activated slide. The position of the toggle joint and the entire latching block must be suitably adjusted to the stroke of the electromagnetic switching device.

SUMMARY OF THE INVENTION

The present invention pertains to a latching block which automatically and simply adjusts to differing strokes of a variety of switching devices. The latching mechanism includes a rack which moves a ratchet wheel and can be coupled, with a positive lock, to the mechanism of the switching device which carries out the switching action. The ratchet wheel engages a lever to maintain the rack in the drawn-in position. The engagement of the ratchet wheel and lever can be eliminated to permit unlocking. To unlock the lock, the present invention provides an electromagnet which can eliminate the engagement. The rack is structured to serve as a switching position indicator so that it is possible to recognize the position of the electromagnetic switching device even when the latching block is covering that switch. Special means or attachment to the switching device are not required for the present invention, as the housing is in the form of an auxiliary switch snap-on block with corresponding coupling means. If the housing does not cover the full width of the electromagnetic switching device, other auxiliary switches can also be set onto the electromagnetic switching device. A manual unlatching slide is also provided to permit unlocking the lock on location, without using the electromagnet.

DETAILED DESCRIPTION

Figure 3:
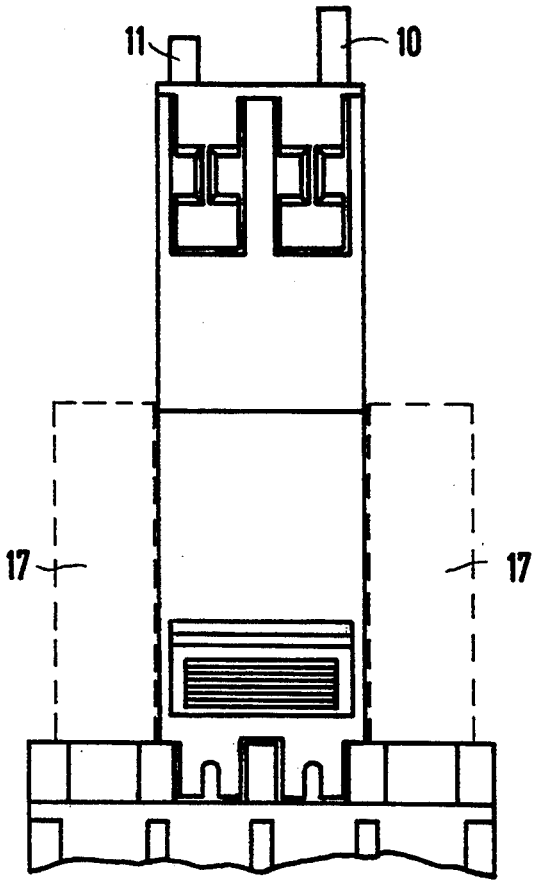
FIG. 3 is a front view of the latching block of FIG. 1.

A latching block is arranged in a housing 1 and includes a rack 2, which acts on a ratchet wheel 4 by means of a pinion 3. A lever 5 is mounted on a pivot and is pressed into engagement with the catches of the ratchet wheel 4 via a spring 6. To disengage, the lever 5 is brought into connection with the anchor 7 of an electromagnet 8. The electromagnet 8 can be activated remotely via the connections 9. The rack 2 projects beyond the contour of the housing with the end 10, as a switching position indicator, as is shown in FIG. 3.

Figure 1:
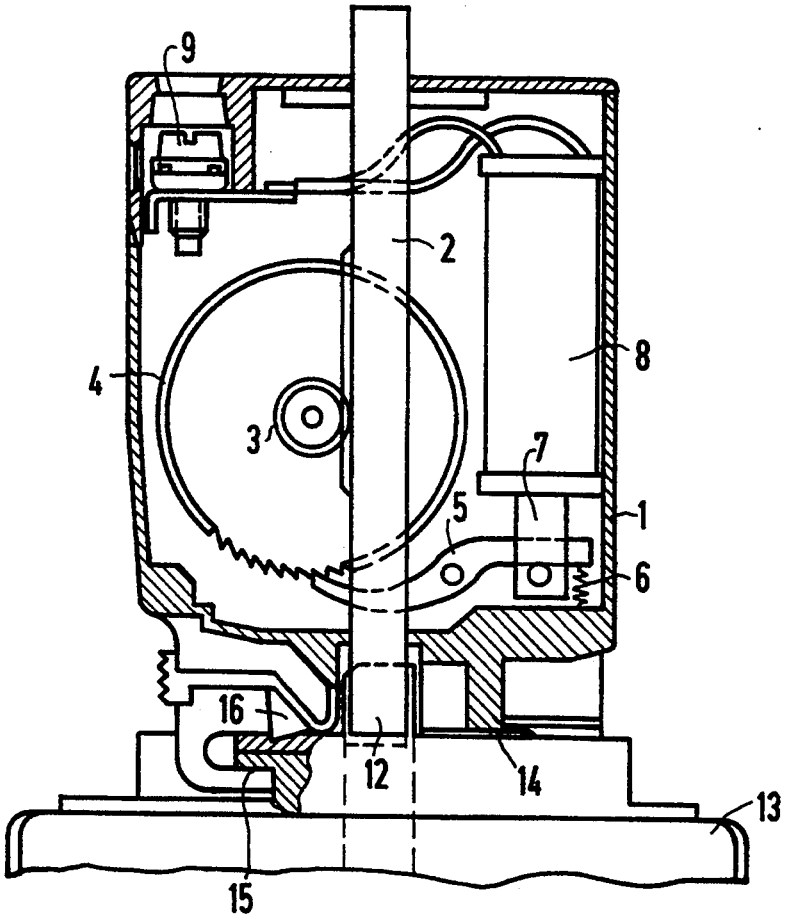
FIG. 1 is a side view of the latching block set onto the electromagnetic switching device, in partial cross-section.
Figure 2:
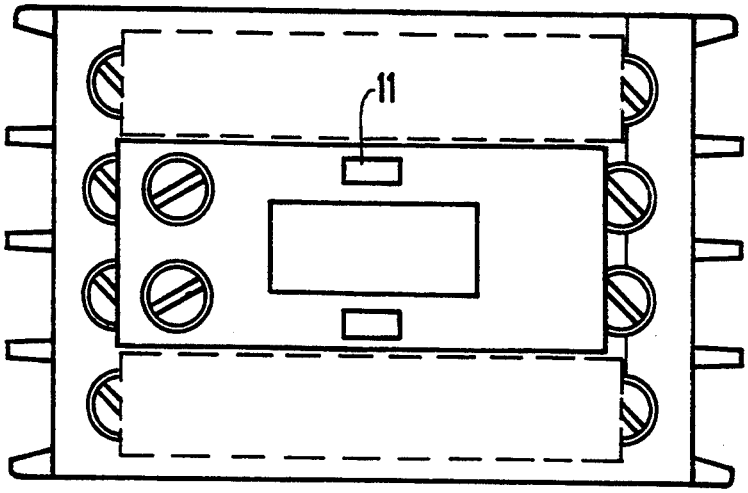
FIG. 2 is a top view of the latching block of FIG. 1.

A manual unlatching slide 11 also projects beyond the housing contour, and is connected with the lever 5. Activation of this manual unlatching slide 4 also causes the lever 5 to disengage the catches of the ratchet wheel 4. The rack 2 is provided with a hammer head 12 on a side facing away from the end 10. The hammer head 12 engages in a corresponding recess 14 of the switching device 13 when the rack 2 is pushed onto the electromagnetic switching device 13. The housing is provided with corresponding hooks 15. These hooks are brought into engagement with corresponding recesses of the housing of the electromagnetic switching device when engaged. This is described, for example, in U.S. Pat. No. 4,956,624, the content of which is hereby incorporated by reference. A catch latch 16, which is molded onto the latching block is used to lock the latching block onto the housing of the electromagnetic switching device. As FIG. 2 and FIG. 3 show, the width of the latching block corresponds to that of parts of two auxiliary switch snap-on blocks. Another two auxiliary switching blocks 17, shown with broken lines in FIG. 2 and FIG. 3, can be fitted in the case of an electromagnetic switching device onto which four auxiliary switching blocks can be set.

When the electromagnetic switching device is switched on, the rack 12 is drawn downward by means of the mechanism of the electromagnetic switching device which performs the switching action (not shown). When this occurs, the ratchet wheel 4 turns in a clockwise direction via the pinion 3. Lever 5 then engages in the catches of the ratchet wheel 4. The rack is held in the drawn-in position by means of the lever 5. As a consequence, this also serves to hold the mechanism of the switching device which carries out the switching action in the working position. By applying voltage to the electromagnet 8, the lever 5 can be drawn out of engagement with the catches of the ratchet wheel, so that the latching is halted and the mechanism of the switching device which carries out the switching action can move back into its rest position. The manual unlatching slide 11 can be pressed into the housing, thus similarly disengaging lever 5 from the catches of the ratchet wheel 4 as an alternative mechanism for disengaging the lever 5 from the catches of the ratchet wheel 4.

What is claimed is:

1. A latching block capable of being coupled to an electromagnetic switching device that includes a mechanism for carrying out a switching action, the latching block comprising:

a housing;

a rack adapted to be coupled to the mechanism of the electromagnetic switching device for carrying out a switching action;

a ratchet wheel including catches and a pinion, said pinion coupled to said rack such that movement of said rack causes said pinion and thus said ratchet wheel to rotate; and a spring-loaded lever having an end capable of engaging catches of said ratchet wheel, wherein said rack holds said electromagnetic switching device in a working position by locking said mechanism of the switching device for carrying out the switching action with a positive lock, said positive lock being unlocked by disengagement of said spring-loaded lever from said catches of said ratchet wheel.

2. The latching block of claim 1, further comprising:
an electromagnet coupled to said lever such that activation of said electromagnet disengages said lever from said catches of said ratchet wheel.

3. The latching block of claim 1, wherein said rack indicates a switching position of said electromagnetic switching device.

4. The latching block of claim 2, wherein said rack includes a switching position of said electromagnetic switching device.

5. The latching block of claim 1, wherein said housing is formed as an auxiliary switch snap-on block having corresponding means for coupling said housing to said electromagnetic switching device.

6. The latching block of claim 2, wherein said housing is formed as an auxiliary switch snap-on block having corresponding means for coupling said housing to said electromagnetic switching device.

7. The latching block of claim 3, wherein said housing is formed as an auxiliary switch snap-on block having corresponding means for coupling said housing to said electromagnetic switching device.

8. The latching block of claim 4, wherein said housing is formed as an auxiliary switch snap-on block having corresponding means for coupling said housing to said electromagnetic switching device.

9. The latching block of claim 1, further comprising:
a manual unlatching slide coupled to said lever,
wherein said manual unlatching slide is capable of disengaging said lever from said catches of said ratchet wheel.

10. The latching block of claim 2, further comprising:
a manual unlatching slide coupled to said lever,
wherein said manual unlatching slide is capable of disengaging said lever from said catches of said ratchet wheel.

11. The latching block of claim 3, further comprising:
a manual unlatching slide coupled to said lever,
wherein said manual unlatching slide is capable of disengaging said lever from said catches of said ratchet wheel.

12. The latching block of claim 4, further comprising:
a manual unlatching slide coupled to said lever,
wherein said manual unlatching slide is capable of disengaging said lever from said catches of said ratchet wheel.

13. The latching block of claim 5, further comprising:
a manual unlatching slide coupled to said lever,
wherein said manual unlatching slide is capable of disengaging said lever from said catches of said ratchet wheel.

14. The latching block of claim 6, further comprising:
a manual unlatching slide coupled to said lever,
wherein said manual unlatching slide is capable of disengaging said lever from said catches of said ratchet wheel.

15. The latching block of claim 7, further comprising:
a manual unlatching slide coupled to said lever,
wherein said manual unlatching slide is capable of disengaging said lever from said catches of said ratchet wheel.

16. The latching block of claim 8, further comprising:
a manual unlatching slide coupled to said lever,
wherein said manual unlatching slide is capable of disengaging said lever from said catches of said ratchet wheel.

* * * * *